United States Patent [19]

Hänni

[11] Patent Number: 4,753,100

[45] Date of Patent: Jun. 28, 1988

[54] PROCESS AND APPARATUS FOR CONTROLLING A LIFTING SUPPORT ON SHEET-METAL PRESSES

[75] Inventor: Eduard Hänni, Zofingen, Switzerland

[73] Assignee: Hammerle AG, Zofingen, Switzerland

[21] Appl. No.: 57,751

[22] Filed: Jun. 3, 1987

[30] Foreign Application Priority Data

Jun. 16, 1986 [AT] Austria ..... 1624/86

[51] Int. Cl.[4] ..... B21D 11/22

[52] U.S. Cl. ..... 72/389; 72/419; 72/24; 364/476; 364/472

[58] Field of Search ..... 72/386, 389, 461, 419, 72/420, 24, 443, 21; 364/476, 475, 472

[56] References Cited

U.S. PATENT DOCUMENTS

| | | | |
|---|---|---|---|
| 4,341,104 | 7/1982 | Jarman | 72/389 |
| 4,594,870 | 6/1986 | Koyama et al. | 72/389 |

FOREIGN PATENT DOCUMENTS

| | | | |
|---|---|---|---|
| 2343674 | 3/1975 | Fed. Rep. of Germany | 72/389 |
| 113932 | 6/1984 | Japan | 72/389 |
| 64730 | 4/1985 | Japan | 72/389 |

*Primary Examiner*—David Jones

*Attorney, Agent, or Firm*—Karl F. Ross; Herbert Dubno

[57] ABSTRACT

For supporting a sheet-metal article which rests on a die and which executes an upward pivoting movement during the pressing operation, a vertically movable supporting unit is provided. The movement of the latter is coordinated with the ram movement and executed at a speed which is in a specific ratio to the speed of the ram. This ratio corresponds to the ratio of the distance between the support and the die edge facing it to half the die width.

7 Claims, 2 Drawing Sheets

PROCESS AND APPARATUS FOR CONTROLLING A LIFTING SUPPORT ON SHEET-METAL PRESSES

FIELD OF THE INVENTION

The present invention relates to a process for controlling a lifting support on sheet-metal presses, the said lifting support serving for the movable support of the sheet-metal article which rests on a die of the press and which, during the pressing operation, executes a pivoting movement about the bending edge located in the center of the die orifice. At the same time, the lifting support is equipped with at least one supporting unit arranged pivotably on a vertically movable lifting member. The invention also relates to a lifting support for carrying out the proposed process.

BACKGROUND OF THE INVENTION

In the working of large pieces of sheet metal, such lifting supports are necessary to prevent deformation and warping of the sheet-metal article which, during the pressing operation, executes an upward pivoting movement about the longitudinal center line of the die orifice.

The known sheet-metal supports provided for this purpose have been unsatisfactory because their movement has not been coordinated in any way with the movement of the press ram, so that these sheet-metal supports have usually overcompensated for the pivoting movement generated as a result of the pressing operation and have caused undesired deformation of the sheet-metal piece. There is also damage when pivoting is undercompensated, in that stresses which can lead to deformation are generated by the overhanging sheet-metal article.

OBJECT OF THE INVENTION

The object of the present invention is to provide a process and a corresponding sheet-metal support which make it possible to support the sheet-metal piece accurately during the bending operation, so that the sheet-metal pieces are kept free of stress and do not undergo any deformation. The basic idea of the present process is to find ways and means of coordinating the vertical upward supporting movement of the lifting support with the movement of the press ram. This coordination then ensures that in both fast and slow lifting movements the movement of the sheet-metal support takes place correspondingly quickly or slowly, so that the sheet-metal piece is always kept free of stress according to the particular requirements.

SUMMARY OF THE INVENTION

The invention provides a process of the type desired, in which the lifting movement of the lifting member directed counter to the ram movement of the press is executed at a speed which is in a ratio to the ram movement corresponding to the ratio of the distance between the support and the die edge facing the support to half the die width. If this condition is satisfied, the movement of the lifting support is coordinated exactly with the movement of the press ram. According to the invention, during the press movement, the movement of the ram is measured and entered in a computer, in which the width of the orifice of the particular die and the distance between the movable lifting member and the die are stored, whereupon the particular speed of movement of the lifting member is calculated on the basis of the abovementioned relation and the calculated values are entered in order to control a drive device for the purpose of moving the lifting member. This also allows for the fact that the movement of the ram is not uniform, but usually decreases during the bending operation; however, according to the invention the movement of the ram is detected continuously and entered in a computer. This computer already stores the values which are decisive for determining the speed of the lifting member. These values are related to the measured values of the ram movement and the particular lifting speed is calculated. On the basis of the calculated values, a continuous control of the drive device of the lifting member is carried out.

The instantaneous speed of movement of the lifting member is calculated according to the formula $$v_s = \frac{b}{v/2} \cdot v_p,$$

in which $v_s$ represents the speed of the lifting member, v the width of the die orifice, $v_p$ the speed of the press during the pressing operation and b the horizontal distance between the edge of the die orifice and the center of the lifting member.

The lifting support suitable for carrying out the method of the invention and intended for supporting the sheet-metal article which, during the bending operation, rests on a die and executes a pivoting movement about the bending edge located in the center of the die orifice is equipped with at least one supporting unit arranged pivotably on a vertically movable lifting member. According to the invention, the lifting support comprises, in order to control the movement of the lifting member, a drive control connected to a computer which is fed by a measuring device which detects the movement of the ram.

BRIEF DESCRIPTION OF THE DRAWING

Two exemplary embodiments of the lifting support are illustrated in purely diagrammatic form in the accompanying drawing, in which.

SPECIFIC DESCRIPTION

Figure 1:
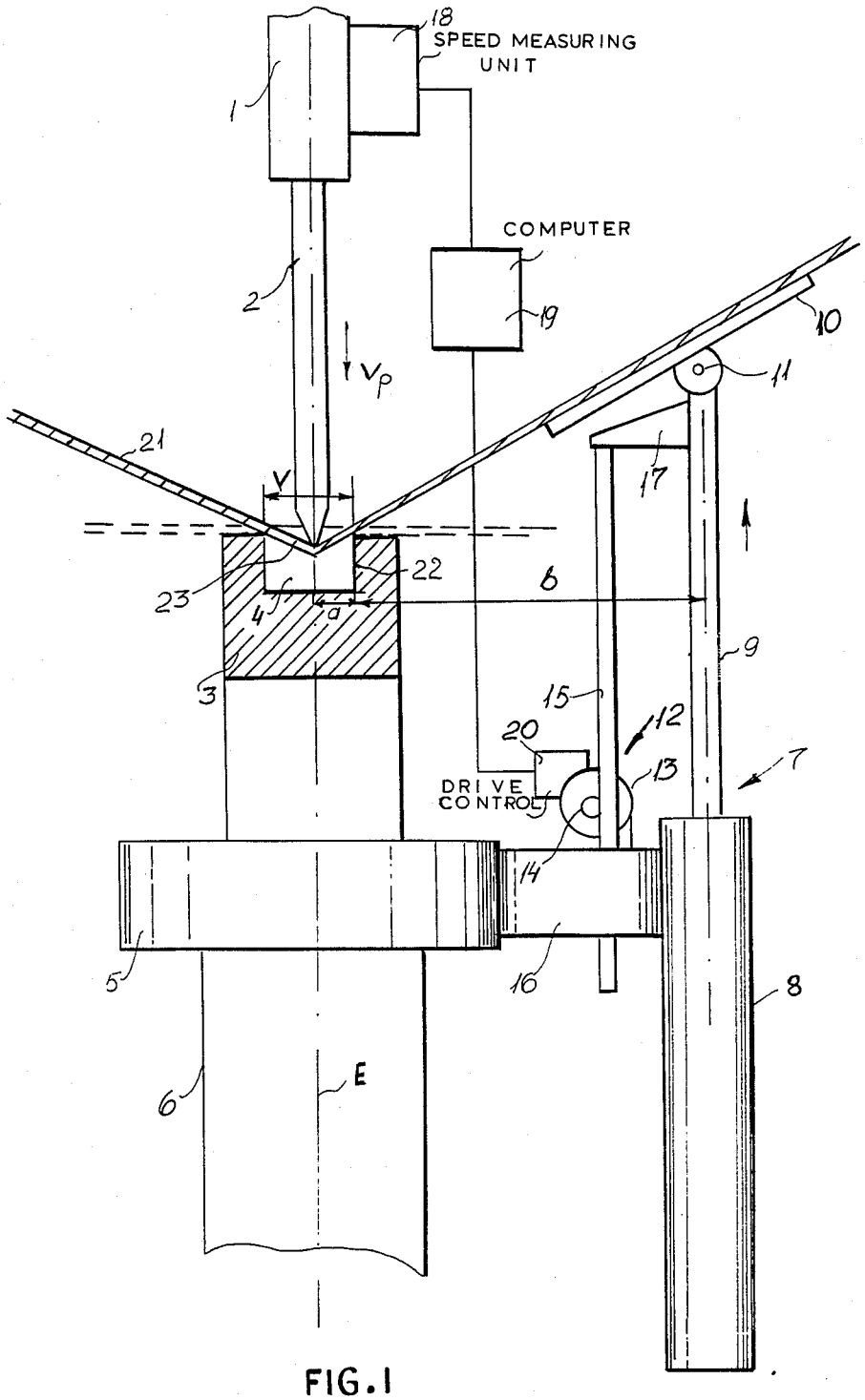
FIG. 1 shows a side view and vertical section of the first embodiment of a lifting support shown diagrammatically.

In the first embodiment illustrated in FIG. 1, a press body 1 which is drawn partially and diagrammatically and which belongs to a sheet-metal press for the working of metal sheets, is equipped with a ram 2. A die 3 has an orifice 4, the said die being arranged replaceably on the press table 5 and press stand 6. A lifting member has a lifting support 9 which is guided in a cylindrical housing 8 and on whose end facing away from the cylindrical housing 8 a supporting unit 10 is arranged pivotably. Of course, there can also be several supporting units 10 which are all fastened to the lifting support 9 so as to be pivotable about a common axis 11.

Furthermore, there is a drive device 12 having a drive motor 13 with a gearwheel 14 meshing with a rack 15 which extends vertically parallel to the lifting support 9 and which is guided in a stand 16 forming part of the press stand 6 and carrying the cylindrical housing 8. The rack 15 is connected to the lifting support 9 by means of a holder 17, so that the vertical movement of the rack 15 causes a corresponding movement of the lifting support 9 together with the supporting unit 10.

Moreover, on the press body 1 there is a measuring device 18 which continuously detects and records the speed of the ram 2, a computer 19 connected to the measuring device 18 being fed with the corresponding values. A drive control 20 is connected, in turn, to the computer 19 and on the other hand influences the drive motor 13.

In FIG. 1, the width of the die orifice 4 has been designated by v. The longitudinal center plane E through the die orifice is the plane in which the ram 2 moves in order to bend a sheet-metal piece 21. The distance between the center line of the lifting support 9 and the edge 22 of the die orifice 4 facing it is denoted by b.

Before the start of the pressing operation, the sheet-metal piece 21 rests flat on the die 3, as represented by dash-dotted lines in FIG. 1. During the pressing operation, the ram 2 is moved downwards at a specific speed, while the sheet-metal articles resting on the die execute a pivoting movement about the bending edges 23 located in the center of the die orifice.

The purpose of the arrangement is to ensure that, during this pivoting movement, the supporting unit 10 executes a coordinated movement directed upwards to assume the position evident from FIG. 1.

For this purpose, the lifting movement of the lifting support 9 directed counter to the downward-directed ram movement of the press 1 is executed at a speed which is in a ratio to the ram movement corresponding to the ratio of the distance b between the support 9 and the die edge 22 facing the support 9 to half the die width v/2. In practice, during the movement of the ram 2, this is measured by the measuring device 18, whereupon the measured values are entered in the computer 19. The width v of the orifice 4 of the die 3 and the distance b between the lifting support and the die have already been stored in this computer, whereupon the particular speed of movement of the lifting member is calculated according to the formula $$v_s = \frac{b}{v/2} \cdot v_p.$$

In this formula, $v_s$ represents the speed of the lifting support 9, b the distance marked, v the width of the die orifice 4 and $v_p$ the speed of the ram.

The speed $v_s$ is therefore determined continuously and the drive control 20 is fed with the values determined so that by means of the drive motor 13 and the gear-wheel 14, the rack 15 is moved upwardly at the necessary speed. This ensures that the supporting unit 10 or supporting units 10 support the corresponding part of the sheet-metal piece 21 during the entire bending operation.

Figure 2:
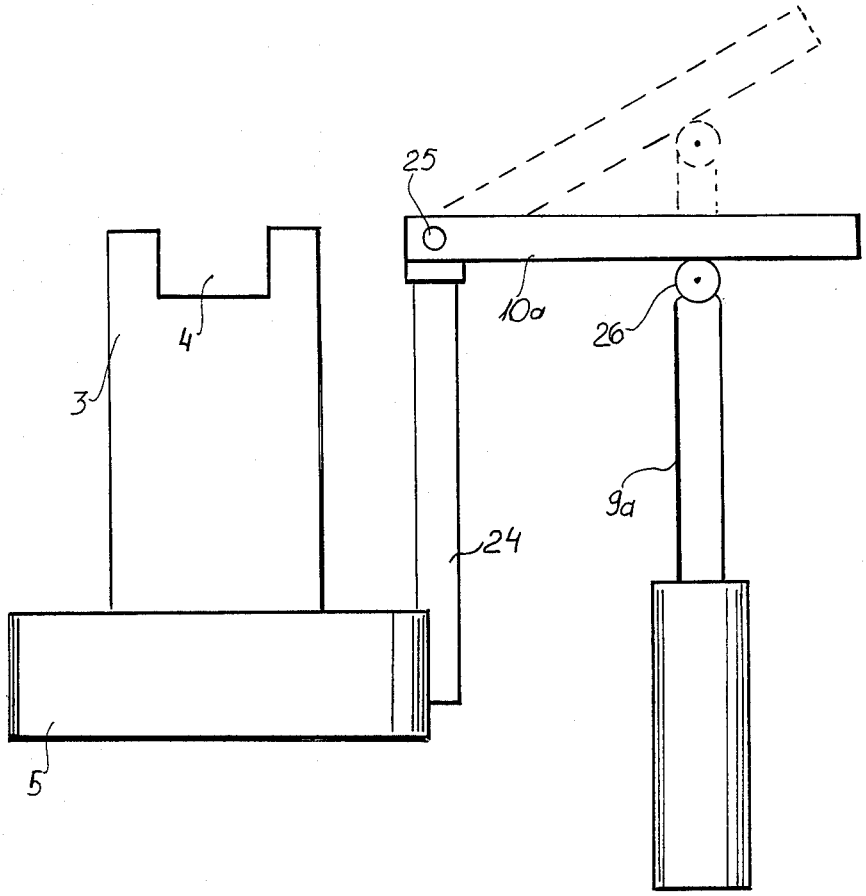
FIG. 2 shows an elevational view of an alternative for arranging the supporting units.

An alternative embodiment of the lifting member 7 is illustrated in FIG. 2. Here, a vertical holder 24 is fastened to the press table 5 and at its end facing away from the press table 5 carries a supporting unit 10*a* which corresponds to the supporting unit 10 and which at one end is fastened to the holder 24 so as to be pivotable about an axle 25. In this design, the equivalent of the lifting support 9 is a lifting support 9*a* carrying, at its free end, a roller 26, against which rests the supporting unit 10*a*. As a result of the movement of the lifting support 9*a*, the latter assumes the upper position represented by dash-dotted lines, and the supporting unit 10*a* assumes the position likewise represented by dash-dotted lines. The movement of the lifting support 9*a* is controlled in exactly the same way as in the device FIG. 1. In this design, too, the movement of the ram 2 is followed precisely and the pivoting of the sheet-metal piece supported exactly.

I claim:

1. A method of controlling the movement of a support for a sheet-metal workpiece to be bent in a bending press having a die orifice across which said sheet-metal workpiece is placed, a ram engaging said workpiece with a bending edge along a plane of a centerline of said orifice, and a support member pivotally connected to a lifting member shiftable vertically and located at a given distance horizontally from said centerline, said method comprising the steps of:

vertically displacing said lifting member with said support member in supporting engagement with said workpiece synchronously with vertical displacement of said ram but in the opposite direction; and controlling the speed of said lifting member upon the vertical displacement thereof so that the speed of said lifting member is in a ratio to the speed of said ram which is equal to the ratio of the horizontal distance between said lifting member and an edge of said orifice closest to said lifting member and half the width of said orifice.

2. The method defined in claim 1 wherein said speed of said lifting member is controlled by:

measuring the speed of said ram;

storing in a computer data representing the width of said orifice and said horizontal distance between said lifting member and said edge of said orifice closest to said lifting member;

feeding said computer with data representing the measured speed of said ram;

calculating in said computer data representing the speed of said lifting member corresponding to said speed of said ram; and operating a drive coupled with said lifting member with the data calculated in said computer.

3. The method defined in claim 2 wherein said data representing the speed of said lifting member is calculated by said computer automatically in accordance with the relation:

$$v_s = \frac{b}{v/2} \cdot v_p$$

in which:

$v_s$=the speed of the lifting member, v=the width of the die orifice, $v_p$=the speed of the ram during a pressing operation, and b=the horizontal distance between the edge of the orifice nearest said lifting member and the lifting member.

4. A bending press for a sheet-metal workpiece comprising:

means forming a die orifice across which said sheet-metal workpiece is placed;

a vertically displaceable ram engaging said workpiece with a bending edge along a plane of a center line of said workpiece;

a lifting member shiftable vertically and located at a given distance horizontally from said center line;

a support member pivotally connected to said lifting member and in supporting engagement with said workpiece; and means for controlling the speed of said lifting member synchronously with vertical displacement of said ram but displacing said lifting member in an opposite direction to that in which said ram is displaced so that the speed of said lifting member is in a ratio to the speed of said ram which is equal to the ratio of the horizontal distance between said lifting member and an edge of said orifice closest to said lifting member and half the width of said orifice, said means for controlling the speed of said lifting member including:

a measuring device responsive to the displacement of said ram and producing data representing the speed of said ram, a computer in which is stored data representing the width of said orifice and said horizontal distance between said lifting member and said edge of said orifice closest to said lifting member, and a drive control connected to said computer and operated in accordance with data calculated by said computer from said stored data and said measuring device data and representing the speed of said lifting member for driving said lifting member.

5. The bending press defined in claim 4 wherein said lifting member includes a lifting rod arranged in a cylindrical housing and driven by a rack meshing with a pinion of a motor provided with said drive control.

6. The bending press defined in claim 4 wherein said support member is pivotally mounted at one edge and rests upon a roller carried by said lifting member.

7. The bending press defined in claim 4 wherein said computer is programmed to calculate the speed of said lifting member in accordance with the relation:

$$v_s = \frac{b}{v/2} \cdot v_p$$

in which:

$v_s$ = the speed of the lifting member, $v$ = width of the die orifice, $v_p$ = the speed of the ram during a pressing operation, and $b$ = the horizontal distance between the edge of the orifice nearest said lifting member and the lifting member.

* * * * *